US006266944B1

(12) United States Patent
Consiglio

(10) Patent No.: US 6,266,944 B1
(45) Date of Patent: Jul. 31, 2001

(54) MACHINE AND PROCESS FOR THE AUTOMATIC ENVELOPING OF MESSAGES WITH A VARIABLE NUMBER OF SHEETS

(75) Inventor: Riccardo Consiglio, Grottaferrata (IT)

(73) Assignee: R.C.P. di Riccardo Consiglio, Grottaferrata RM (IT)

( * ) Notice: Subject to any disclaimer, the term of this patent is extended or adjusted under 35 U.S.C. 154(b) by 0 days.

(21) Appl. No.: 09/230,822

(22) PCT Filed: Aug. 14, 1997

(86) PCT No.: PCT/IT97/00212

§ 371 Date: Feb. 10, 1999

§ 102(e) Date: Feb. 10, 1999

(87) PCT Pub. No.: WO98/07583

PCT Pub. Date: Feb. 26, 1998

(30) Foreign Application Priority Data

Aug. 19, 1996 (IT) ..... RM96A0584

(51) Int. Cl.[7] ..... B65B 63/04

(52) U.S. Cl. ..... 53/429; 53/206; 53/447; 53/460; 53/493; 53/540; 53/569

(58) Field of Search ..... 53/447, 460, 540, 53/206, 493, 495, 569

(56) References Cited

U.S. PATENT DOCUMENTS 3,983,679 * 10/1976 Zemke ..... 53/21
4,972,655 * 11/1990 Ogawa ..... 53/155
5,027,587 * 7/1991 Ramsey ..... 53/493
5,155,973 10/1992 Hipko et al. .
5,196,083 * 3/1993 Baker et al. ..... 156/364
5,640,831 * 6/1997 Harrod et al. ..... 53/429
5,794,409 * 8/1998 Akridge et al. ..... 53/460

FOREIGN PATENT DOCUMENTS 0 272 808 6/1988 (EP) .
0 297 843 1/1989 (EP) .
0 519 565 12/1992 (EP) .
0 541 836 5/1993 (EP) .
1 492 812 8/1967 (FR) .
2 719 522 11/1995 (FR) .

* cited by examiner

*Primary Examiner*—Stephen F. Gerrity
*Assistant Examiner*—Hemant M. Desai
(74) *Attorney, Agent, or Firm*—Browdy and Neimark

(57) ABSTRACT

A machine and a process for the automatic enveloping of messages with a variable number of sheets provide; the supply of message sheets on a first accumulating plane (9, 48); the supply of envelope sheets on a second accumulating plane (17, 28, 29), which forms an angle with the first accumulating plane, such as to obtain the overlaying of the front ends of the envelope sheets and message sheets; the simultaneous feeding of the envelope and message sheets such that complete overlaying therebetween is obtained; and the simultaneous folding of the envelope sheets and message sheets, obtaining an envelope.

12 Claims, 7 Drawing Sheets

MACHINE AND PROCESS FOR THE AUTOMATIC ENVELOPING OF MESSAGES WITH A VARIABLE NUMBER OF SHEETS

BACKGROUND OF THE INVENTION

1. Technical Field of the Invention

The present invention relates to a machine and a process for the automatic enveloping of messages with a variable number of sheets, starting as single unfolded envelope sheets and message sheets.

2. Prior Art

The actual printing and dispatching on large scale of enveloped messages are handled by automatic systems, which handle in batches the messages with variable size, such that their subsequent enveloping can be efficiently automated. This has the disadvantage of making necessary a subdivision in distinct processing steps which, due to the higher number of utilized personnel, involves a series of problems not of little importance (organization, trade-union, time, confidentiality and reliability).

A further disadvantage is due to the need of providing a burdensome cost for equipment, offices and postal fees.

From EP-A-0 541 836 a method for mailing production is known, in which a first sheet is printed by a computer printer and then augmented by a second sheet prior to entering folding means, one of the sheets being twice transversely folded. The enveloping of messages with a variable number of sheets is not addressed.

From EP-A-0 297 843 an apparatus for manufacturing sealed postal mails or the like envelope assemblies is known, which in particular discloses grouping means to selectively add additional inserting elements to the message sheets. Being the process a continuous process, it is compelling to add these additional inserting elements in a single step. Therefore, a particular structure has to be adopted for the additional elements.

OBJECT AND SUMMARY OF THE INVENTION

The present invention overcomes such prior art problems by providing a process for the automatic enveloping of messages with a variable number of sheets, starting as from single envelope sheets and unfolded message sheets, characterized in that it comprises the following steps:

a) supplying one or more message sheets and releasing the same on a first accumulating plane;

b) supplying one or more envelope sheets and releasing the same on a second accumulating plane which forms an angle with the first accumulating plane, such as to obtain the overlaying of the front ends of said envelope sheets and of the message sheets, once released;

c) simultaneously feeding said envelope sheets and message sheets so that complete overlaying thereof is obtained; and d) simultaneously folding said envelope sheets and message sheets so that the remaining sheets are enveloped by one of said envelope sheets, obtaining an envelope.

The present invention further provides a machine for the automatic enveloping of messages with a variable number of sheets, characterized in that it comprises:

first means for supplying one or more message sheets;

a first accumulating plane of said sheets, located downstream of said first means for supplying message sheets;

second means for supplying one or more envelope sheets;

a second accumulating plane of said second envelope sheets, located downstream of said second means for supplying said envelope sheets and forming an angle with the first accumulating plane, so that, once said message sheets and envelope sheets are supplied, an overlaying of their front ends is obtained;

means for simultaneously feeding said message sheets and envelope sheets, and obtaining complete overlaying thereof; and means for simultaneously folding said envelope sheets and message sheets, for obtaining an envelope.

The present invention further provides an envelope sheet, for enveloping, once folded, one or more message sheets, characterized in that it is rectangularly-shaped and comprises:

a transversal application of glue along a face, close to one of its transversal sides;

two longitudinal applications of glue, along said face, close to its respective longitudinal sides;

at least one transparent window; and two longitudinal perforation lines, close to the longitudinal applications of glue respectively, disposed on opposite sides with respect to the longitudinal sides of the sheet.

The need of handling in batches is therefore reduced, as it is possible, by means of the present invention, to handle automatically the processing of messages with variable size, as the same can be enveloped at the time of being issued.

An additional advantage is due to the fact that handling can be performed by only a single processing step, in a single office and by a single operator only, not necessarily skilled. The operator, in fact, will have to control the starting and ending conditions only of the processing, as well as some limited and simple operations, such as handling of messages not automatically processable, advance maintenance, removal of anomalous messages and reset controls.

A further advantage is due to the decrease in the office and equipment costs; the machine according to the present invention in fact preferably works either with printers of small/medium type (30 sheets/minute) or with devices for supplying sheets, enabling the implementation of complete printing and shipping systems with low costs and size, to be installed in non-dedicated premises, such as for example in any working place, by utilizing, if necessary, already present computer equipment.

A still further advantage is due to the fact that in this way the delivery is timely performed, as the abovementioned cheap installation and handling encourages decentralization (and therefore the closeness to the delivery address) of the printing and shipping system so obtained.

A still further advantage is due to the quality of the processing, since as mailing is performed during the same processing step in which the printing operation is performed and by the same operator in charge of the procedure handling, a better result is obtained as far as processing time, confidentiality, performance and reliability are concerned.

The present invention will be illustrated herebelow by referring to a preferred embodiment thereof, explained by way of a non-limiting example.

BRIEF DESCRIPTION OF THE DRAWING

The annexed drawings will be herebelow referred to, wherein.

DETAILED DESCRIPTION OF THE PREFERRED EMBODIMENT(S) OF THE INVENTION

Figure 1A:
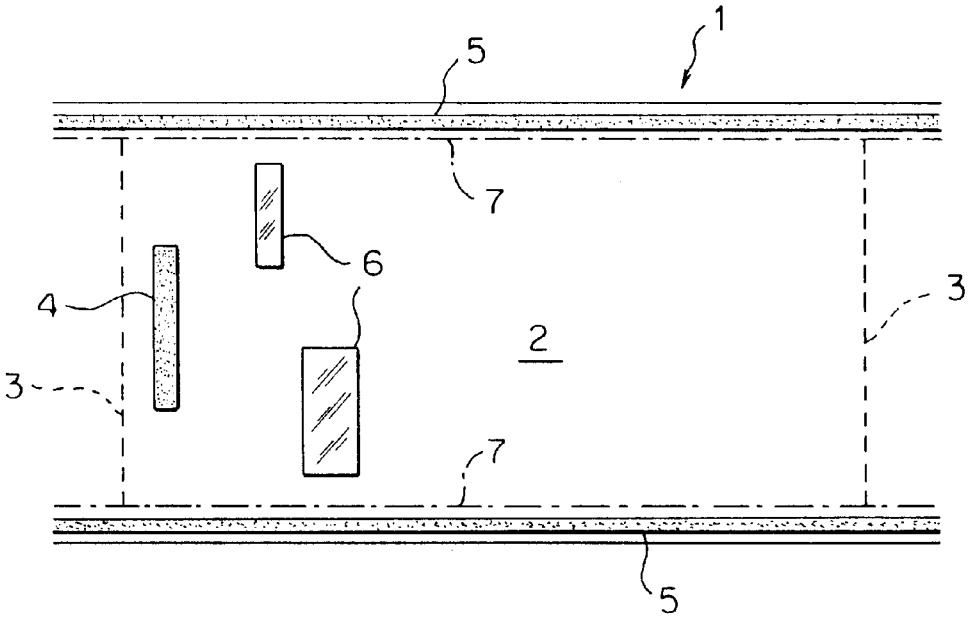
FIGS. 1A and 1B show a partial top plan view of a continuous form by which the envelope sheets are supplied to the machine according to the present invention.

FIG. 1A shows a partial top plan view of a continuous form 1. Said form is divided into rectangular areas 2, from now on referred to as envelope sheets. The envelope sheets 2 are assigned to the self-packing of an envelope with a variable number of message sheets. The message sheets can be constituted both by messages having a personalized content, from now on referred to as personalized sheets (a letter, for example), and by sheets having additional information, advertising for example, from now on referred to as depliants.

The envelope sheet 2 is delimited by two transversal perforation lines 3, shown vertically in the figure, with dotted lines. Said lines 3 are the lines of the continuous form 1 along which sectioning will be performed by the enveloping machine, with consequent separation of an envelope sheet 2 from the continuous form 1. Each of the envelope sheets 2 is such as to provide, furthermore, a transversal area 4 and two longitudinal areas 5 on which glue, heat seal lake for example, is arranged, to enable, after the folding steps, the gluing of overlapping envelope edges on one another by sealing means in the enveloping machine. The glue is such that it preferably has a low melting temperature, lower than 100°. Two transparent windows 6 are further provided, for allowing view of the sender and addressee addresses; said addresses will be present on the last message sheet, which sheet will be positioned immediately below the envelope sheet 2. Longitudinal perforation lines 7 of the continuous form 1 are further provided, shown with dotted and dashed lines in the figure, for allowing a user to open the envelope, once formed.

Figure 1B:
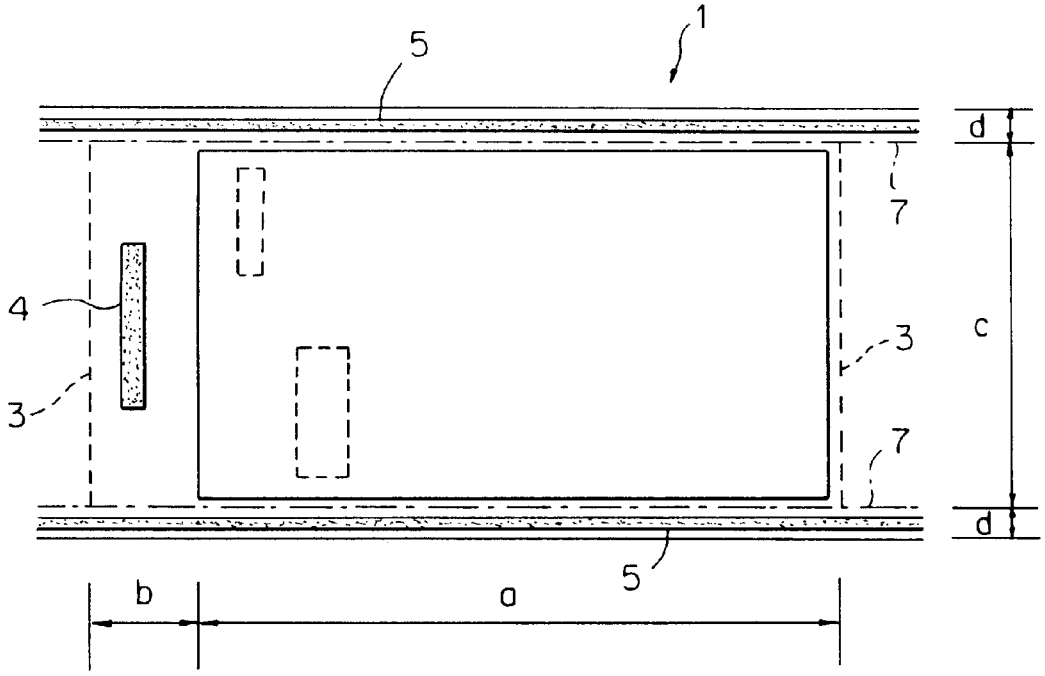

For the sake of clarity, in the subsequent FIG. 1B the continuous form 1 shows also the dimensions of a message sheet 2A (personalized or depliant) inside an envelope sheet 2; in this way the position of said sheets 2A with respect to the envelope sheet 2 prior to the folding operations can be clearly seen. It is worth noting that the longitudinal dimension of each envelope sheet 2 is equal to a+b, wherein a is the longitudinal dimension of the message sheets to be inserted, whereas b is the longitudinal dimension of the area of the envelope sheet 2 designed for the automatic closure of the long side of the self-packed envelope. The transversal dimension of each envelope sheet 2 is equal to c+2d, wherein c is the transversal dimension of the message sheets to be inserted, whereas d is substantially the transversal dimension of-the areas of the envelope sheet 2 having the glue longitudinal arrangement 5.

The supply modes of the envelope sheets and message sheets to the machine provide, in the preferred embodiment, the following operations:

a) supplying one or more message sheets and releasing the same on a first accumulating plane;

b) supplying one or more envelope sheets and releasing the same on a second accumulating plane which forms an angle with the first accumulating plane, such as to obtain the overlaying of the front ends of said envelope sheets and of the message sheets, once released;

c) simultaneously feeding the envelope sheets and message sheets so that a complete overlaying therebetween is obtained; and d) simultaneously folding the envelope sheets and message sheets so that the remaining sheets are enveloped by one of the envelope sheets, obtaining an envelope.

Figure 2:
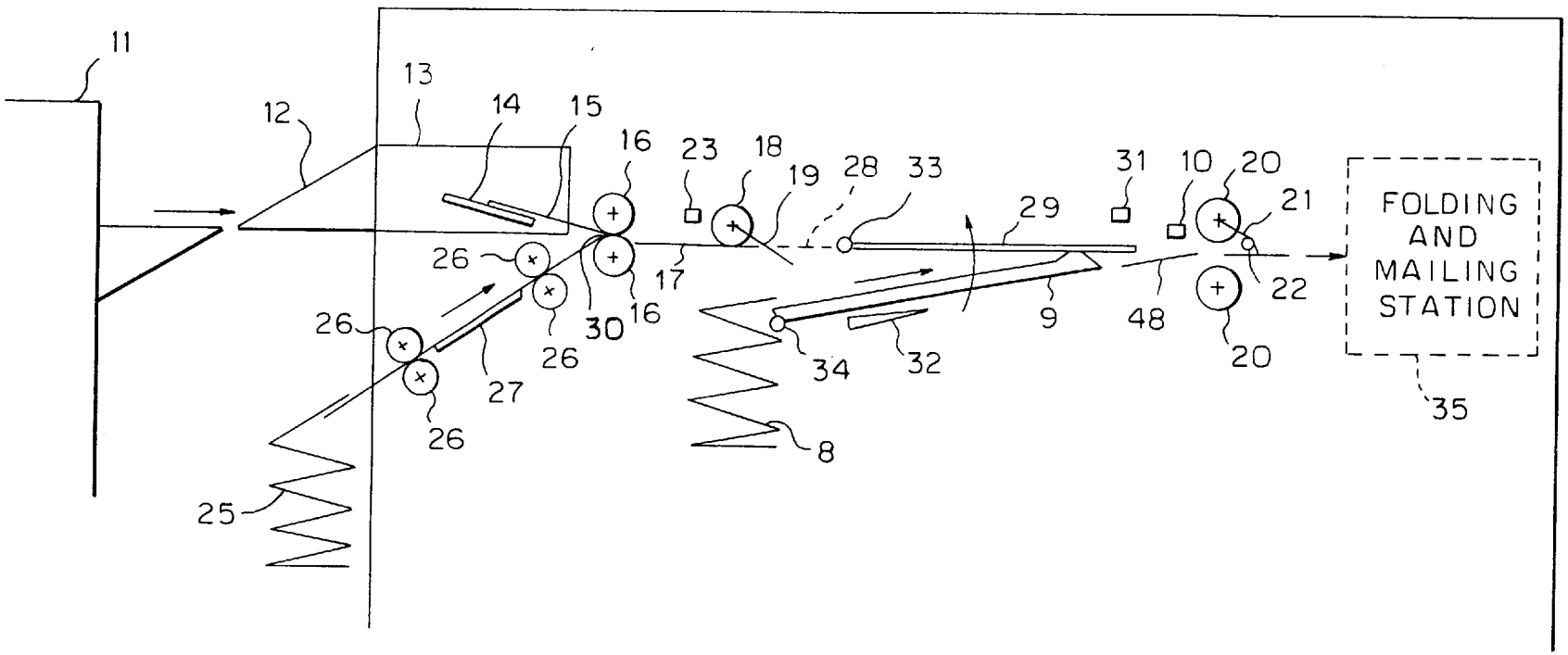
FIG. 2 shows a schematic cross-sectional view of the enveloping machine.

FIG. 2 shows a schematic cross-sectional view of an example of enveloping machine by which the process according to the present invention can be performed. In the figure there are not shown in detail the wired circuits enabling, by means of a control logic later explained, the alternating of the various steps necessary for the enveloping procedure, as their implementation is considered to be known to the person skilled in the art.

Under the numeral 8 a supply device of a depliant form is referred to, schematically shown in the figure, composed by known members for supplying and sectioning a continuous form, such that depliants can be input, one by one, on an inclined sheet accumulating plane 9, 48, comprising a first tray 9 and a platen 48. Once on the plane 9, 48 the depliant will be fed by the feeding means, not shown in the figure, until its front end reaches the area between the two rollers 20, shown slightly detached one from the other in the figure. The front end of the depliants will contact a stopping projecting member 21, fastened to the upper of the rollers 20, integral therewith and located above a bar 22.

Each depliant continues to be supplied by the supply device 8 on the inclined plane 9, 48 until an end-of-sequence symbol, located on the last of the depliants to be inserted inside a single envelope, is detected by means of a detecting device 10 (a photoelectric cell, for example). Said detection causes a signal LD (Last Depliant) to be emitted by the machine control logic, further to which a subsequent supply of the personalized sheets coming from a printer 11 will be enabled.

The preferred embodiment of the enveloping machine according to the present invention is such that it provides a supplying structure 12, triangularly-shaped when seen transversally, whose lateral dimensions allow a personalized sheet, a sheet A4 for example, to pass through. Said sheet, once outputted from the printer 11, flows along the structure 12 base plane from left to right. A guiding section 13 is located close to the supplying structure 12; it is shown rectangularly-shaped in the figure and its transversal dimensions are such that allow the personalized sheet to pass through, which sheet flows in this case too, along the section base plane, from left to right. Inside the guiding section 13 there are provided members for inviting the personalized sheet to flow horizontally, for avoiding undesired trajectories, for example due to the alteration of the message sheet edges caused by the paper heating. Said inviting members comprise, in the embodiment shown in the figure, a foil section 14 and a filiform profile 15 located over the foil section 14 and fixed to it, such that the sheet cannot move upwards.

A pair of feeding rollers 16 is then provided, located one over the other, for enabling further feeding of the personalized sheet along a plane 17, until a further roller 18 is overcome. The plane 17 is located below the conveying plane of the rollers 16, to allow a correct supply. The roller 18 shown in contact with the plane 17, is vertically movable between the operating position shown in the figure and a slightly lifted position, whose functions, later explained, will enable the supply of the continuous form 1 from which the envelope sheets 2 can be obtained by tearing. The roller 18 is made of a material having a low friction coefficient against the material (usually steel) with which the plane 17 is made. Around the roller 18 a downwardly projecting member 19 is provided, laterally blocked on the roller, whose function is to direct the personalized sheet on the inclined tray 9 and on the platen 48 through an aperture not shown in the figure.

Once on the plane 9, 48 the personalized sheet too will be fed, until its front end reaches the area between the two rollers 20. The front end of the personalized sheet also in this case will contact the stopping projecting member 21. The correct alignment of the sheets ones on over each other on the plane 9, 48 will be also allowed by the transversal dimensions of the plane itself, substantially corresponding to those of a depliant or a personalized sheet.

Once the supply of the last personalized sheet is finished, the machine logic control will control, by emitting a LPS (Last Personalized Sheet) signal, the detaching of the roller 18 from the plane 17, to allow the subsequent supply of the continuous form 1.

Figure 3:
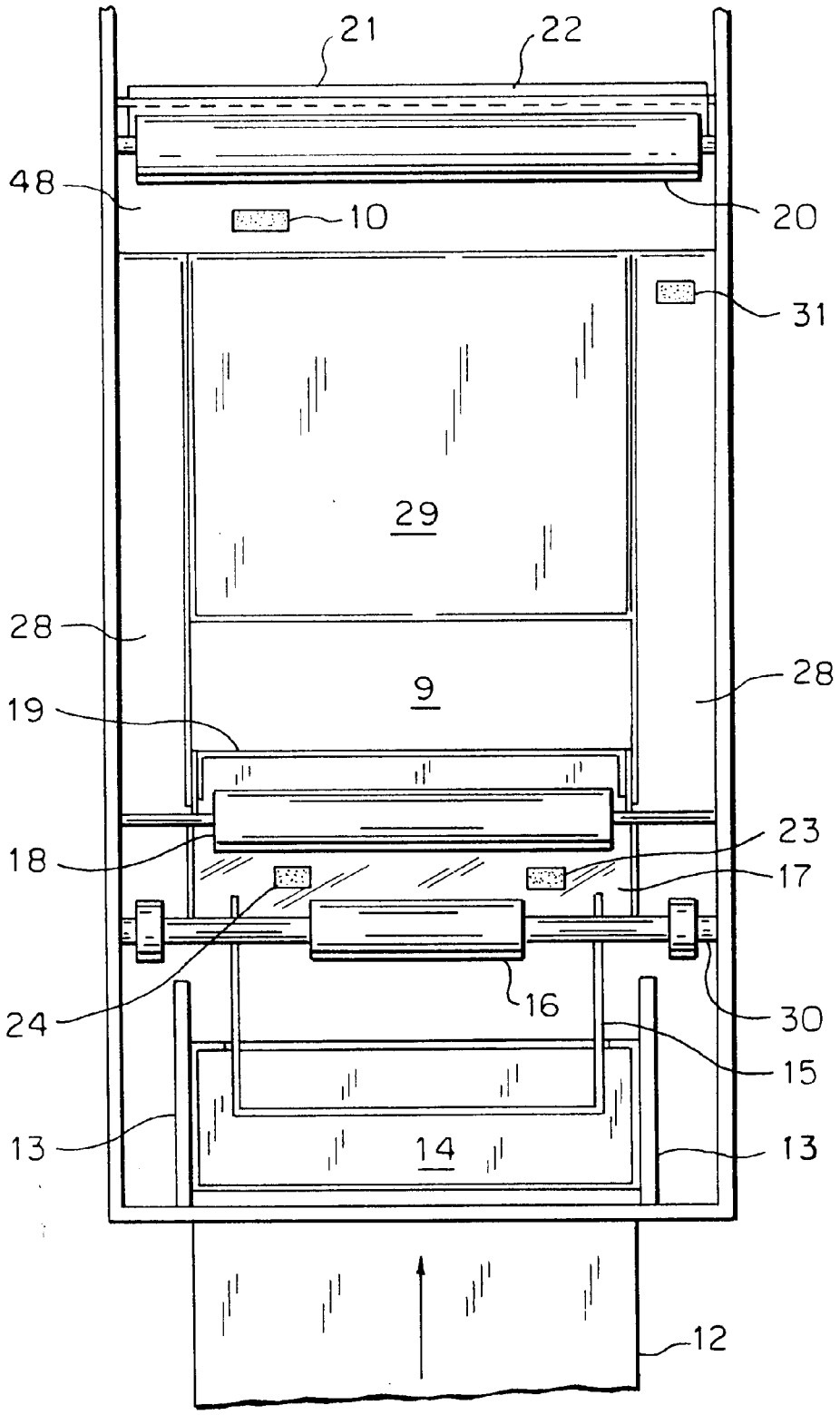
FIG. 3 shows a schematic plan view of the enveloping machine.

In particular, the end of the personalized sheet accumulating cycle will be detected for example by a double subsequent detection (for more safety) by the photoelectric cells 23 and 10, explained in a more detailed manner in the subsequent FIG. 3. Said photoelectric cells detect (after a reading command given by an additional photoelectric cell 24 shown in the subsequent FIG. 3) the presence of graphic symbols on the last personalized sheet; the reading of said symbols causes the detaching of the roller 18 from the plane 17, the blocking of the printer 11 and the start of the supply operation of the continuous form 1, in form of a reel or pack, from a supply device 25. The continuous form 1 is then fed by two pairs of supply rollers 26, located upstream and downstream of a laterally profiled guide 27 respectively. The form 1 is conveyed on the horizontal plane 17-28-29 through a slit 30 and pushed over it by the combined action of the rollers 16 and 26.

With the roller 18 lifted, the continuous form 1 passes through the plane 28 and a horizontal tray 29. The form does not fall into the inclined tray 9, as its transversal dimensions are greater than the ones of a personalized sheet (see also FIGS. 1A and 1B) and therefore greater than the ones of the aperture which permits the personalized sheets to reach the inclined tray 9, located along the plane 28, allowing the supply of the personalized sheets to the inclined plane 9. Further to a subsequent reading of the graphic symbols located in the front part of each of the envelope sheets 2, performed by a photoelectric cell 31, blocking of the rollers 26 only takes place; the contemporary traction by the persisting rotation of the rollers 16 causes the form 1 be torn out along the transversal perforation lines 3 previously described by reference to the FIGS. 1A and 1B. Subsequent to the tear, the rectangular area 2 constituting the envelope sheet will be located longitudinally between the roller 18 (lifted) and the stopping projecting member 21.

In the area close to the stopping projecting member 21, a partial overlaying of the envelope sheet 2, the personalized sheets and the depliants will then occur. Alternative embodiments of the present invention can provide for example the presence of more envelope sheets (in case the lower envelope sheets have been handled such that they can act themselves as depliants), or arrangements which do not provide the presence either of personalized sheets or depliants Subsequent to the supply of the envelope sheet 2, a LES (Last Enveloping Sheet) signal of end of supply will be emitted, according to modes similar to the ones previously explained, for enabling the start of the subsequent folding and mailing cycle, to be performed by means of a folding and mailing station 35.

Alternatively, in case of an anomalous message, due for example to the presence of a number of sheets greater than the maximum number set when designing the machine, block of the processing will instead take place. In this case, the presence of a cam 32 enables the simultaneous lifting of the trays 29 and 9, rotatable around hinging devices 33 and 34 respectively; this fact is also due to the particular shape of the inclined tray 9 (shaped in a slightly raised manner in its substantially front part) enabling the contact with the horizontal tray 29. Further to the rotation of the two trays, the anomalous message can be removed by an operator and said trays will be put again in their usual position.

The subsequent FIG. 3 will be from now on referred to, showing a schematic plan view of the machine according to the present invention. In this figure, it is possible to understand with better clarity, in particular, the lateral extension of the various planes along which the envelope sheets and message sheets pass through, as well as the preferred position of the various control photoelectric cells explained with reference to the preceding figure.

Starting from the bottom of the figure, there are provided the supplying structure 12, the foil section 14, the filiform profile 15 and the guiding section 13. The upper of the rollers 16 is located above the slit 30, by which the continuous form to form envelope sheets is supplied. On the plane 17 the two photoelectric cells 23, 24 are located for the purposes already explained. On the sides of the plane 17 and of the subsequent tray 29 the plane 28 is located, the presence of which allows the feeding of the envelope sheets, inputted from the slit 30, up to the contact with the stopping projecting member 21. On said plane 28 the photoelectric cell 31 is provided, for enabling the block of the rollers 26 and the consequent tear of the envelope sheets from the continuous form.

The upper roller 20, the stopping projecting member 21 and the bar 22 are also shown, together with the photoelectric cell 10, located above the inclined plane 48, for detecting the last message sheet.

Figure 4:
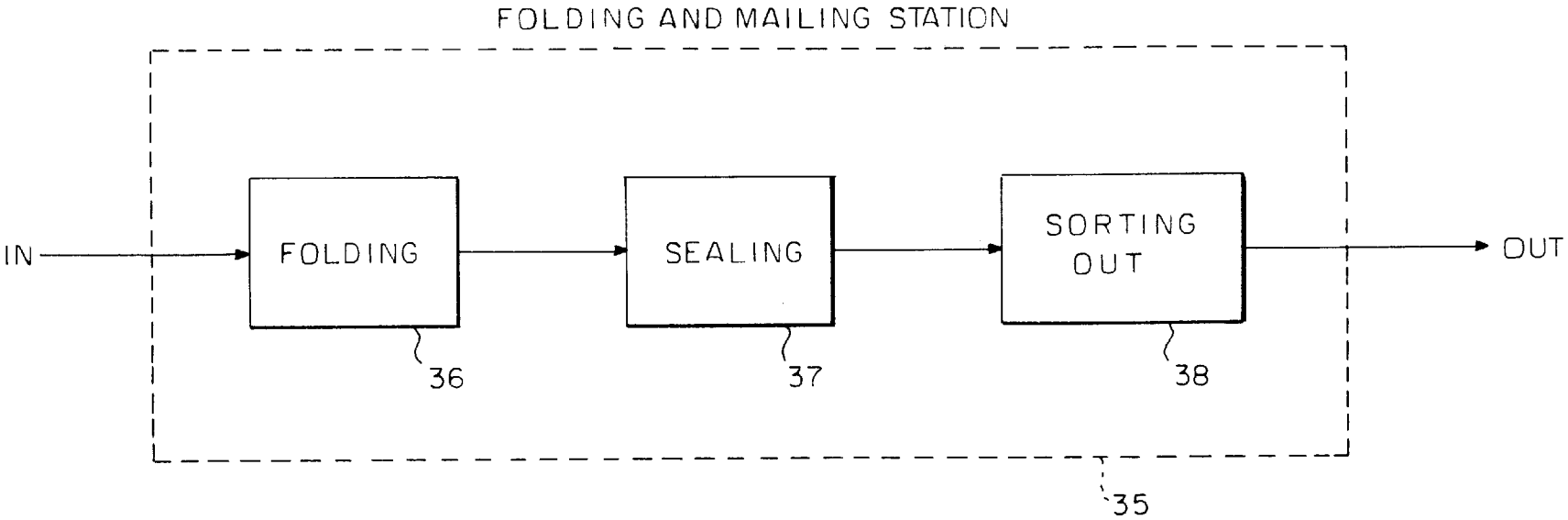
FIG. 4 shows a diagram related to the folding and mailing station in the enveloping machine.

By referring to the subsequent FIG. 4, a diagram related to the folding and mailing station 35 in the enveloping machine is shown. Said station comprises a folding unit 36, receiving as input the envelope sheets together with the message sheets and returning as output an envelope, ready for the sealing operation by the unit 37. The sealing will be performed through a combined action of temperature, time and pressure, for example by means of floating pad resistances for tempering the glue located in the areas 4 and 5 and by rollers for the subsequent sealing. Once sealed, the envelope can be sorted out (according to the post code, for example) by means of a sorting out unit 38, located downstream of the sealing unit 37. The mail sorting out according to the post code could be performed for example by a multiple-way shunting device and a plurality of receiving stations.

Figure 5A:
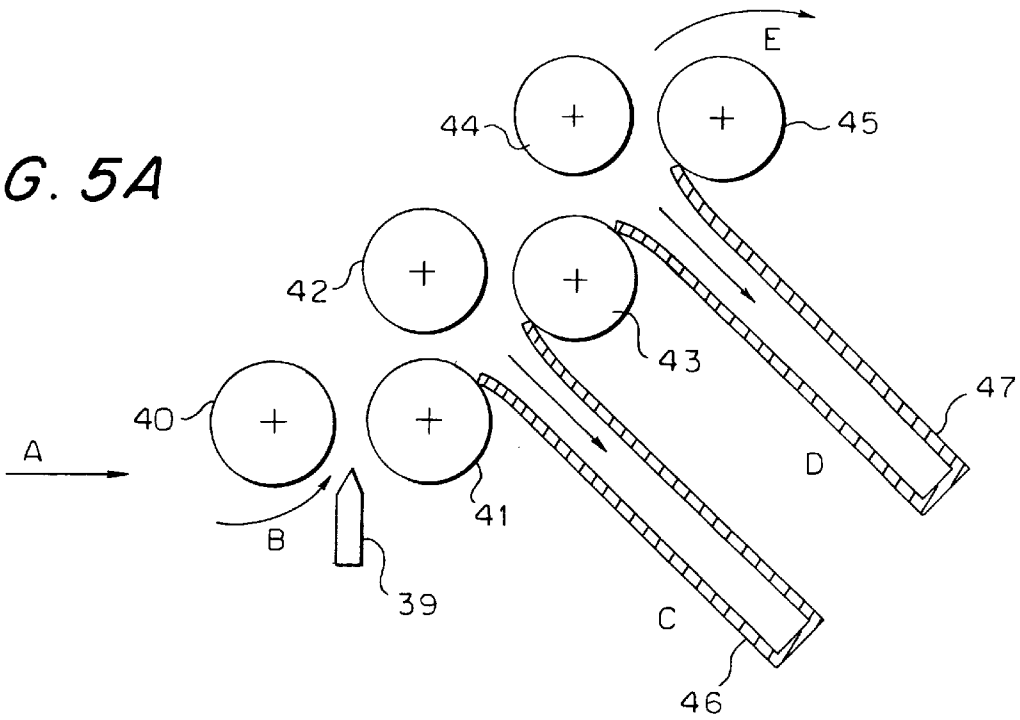
FIGS. 5A and 5B show the modes according to which the envelope sheets and message sheets are simultaneously folded.

The subsequent FIG. 5A shows in detail an exemplary embodiment of the folding unit 36. In the FIG. 5B the results obtained on the sheet assembly during the various folding operations are shown.

By referring to the FIG. 5A, the arrow A shows the feeding direction of the sheet assembly. Once said sheet assembly comes close to a folding blade 39, this pushes it through a first pair of rollers 40, 41 by performing a first fold. Subsequently, the sheet assembly with the first fold is pushed through a further pair of rollers 41, 42 inside a pocket 46. Inside said pocket a stop device is provided, not shown in the figure, for swelling the sheet assembly and permitting it to reach a subsequent pair of rollers 42, 43. Said rollers perform a second fold of the sheet assembly and push it, through an additional pair of rollers 43, 44, inside a pocket 47 until reaching another stop device, not shown in the figure too, for swelling again the sheet assembly and permitting it to reach rollers 44, 45. The rollers 44 and 45 perform finally a third and definitive fold of the sheet assembly.

Figure 5B:
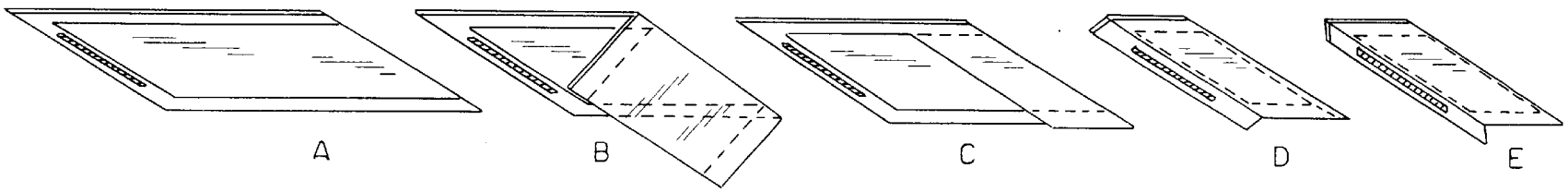

The subsequent FIG. 5B shows the effect of the various operations on the sheet assembly. The letter A (see the corresponding letter A of FIG. 5A) shows the shape of the sheet assembly at the entrance of the folding station; the letter B shows the shape of the sheet assembly subsequent to the folding performed by the blade 39; the letter C shows the shape of the sheet assembly during the insertion into the pocket 46; the letter D shows the shape of the sheet assembly during the insertion into the pocket 47; and the letter E shows the shape of the sheet assembly during the folding performed by the pair of rollers 44, 45.

Figure 6A:
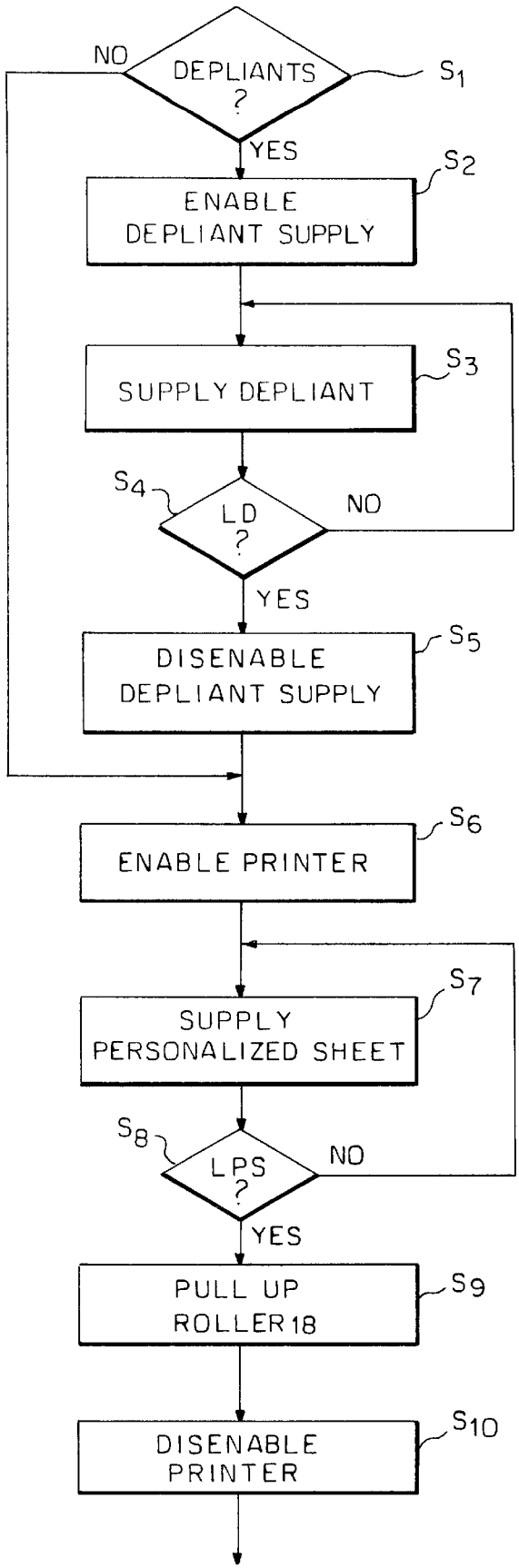
FIGS. 6A and 6B show a flow chart which represents the operation modes of the control logic for controlling the machine according to the present invention.
Figure 6B:
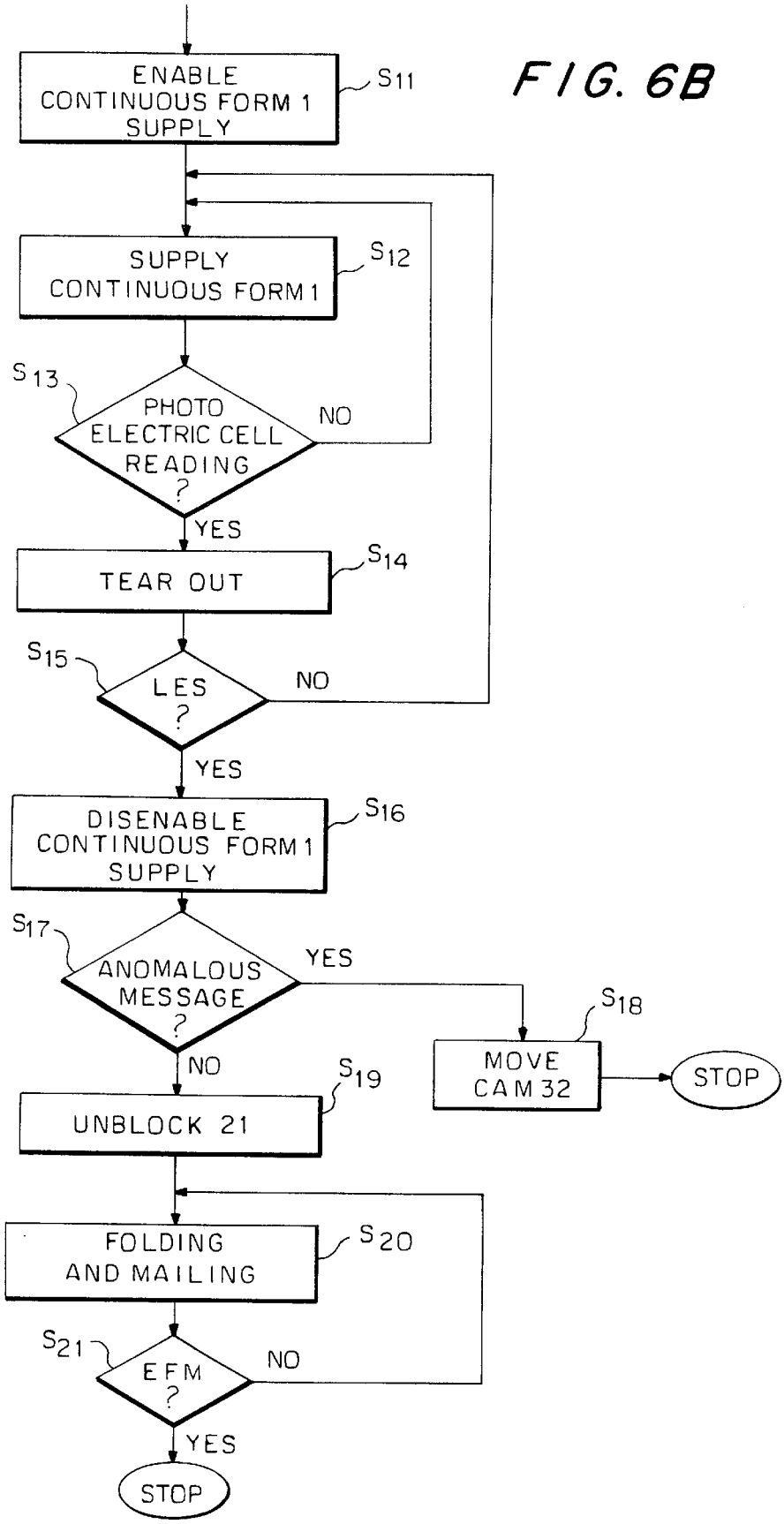

The FIGS. 6A and 6B will be then referred to, wherein a flow chart is shown for representing by way of example the operation modes of the control logic controlling the machine according to the present invention.

In a first step S1 the need or not to put depliants inside a single envelope sheet is checked. In the affirmative, in a subsequent step S2 the supply by the depliant supply device 8 is enabled, supply then provided for in the subsequent step S3; the depliant supply ends by detecting the signal LD of the last depliant in the control step S4; once the supply by the device 8 is disenabled in a step S5, the printer 11 is enabled in a step S6, with consequent supply of the personalized sheets in a subsequent step S7; the supply of the personalized sheets ends by detecting a signal LPS of the last personalized sheet in the control step S8; once the roller 18 is detached from the plane 17 in a step S9, the printer 11 is disenabled in a step S10 and the supply of the continuous form 1 is subsequently enabled in a step S11 (see FIG. 6B), supply then provided for in the step S12; the tear out of the continuous form 1 (step S14) to form the envelope sheet 2 takes place after the reading by the photoelectric cell 31 (step S13); the supply of the continuous form 1 with consequent formation of one or more envelope sheets 2 ends by detecting the signal LES of the last envelope sheet in the step S15. After the disenabling of the supply of the continuous form 1 (step S16), the control unit checks then the presence or absence of an anomalous message (step S17); in the affirmative, in the step S18 the activation of the cam 32 is provided, with the subsequent removal of the sheets by an operator, with end of the cycle; alternatively, the unblock of the projecting member 21 in a step S19 and the subsequent folding and mailing operations in a step S20 are provided, operations ending with detection of a signal EFM in the step S21, for signaling the end of the folding and mailing operations.

While this invention has been described in detail with reference to a preferred embodiment, many modifications and variations would present themselves to those skilled in the art without departing from the scope and spirit of this invention. The scope of the invention is, therefore, indicated by the following claims rather than by the foregoing description.

What is claimed is:

1. A process for the automatic enveloping of messages with a variable number of sheets, starting as single envelope sheets (2) and unfolded message sheets, comprising:

a) supplying one or more message sheets and releasing said one or more message sheets to a first accumulating plane (9, 48) limited to accumulating message sheets and comprising a first tray (9) and a platen (48);

b) supplying an envelope sheet (2) and releasing said envelope sheet to a second accumulating plane (17, 28, 29), said second accumulating plane forming an angle with said first accumulating plane (9, 48), to obtain overlaying of front ends of said envelope sheet (2) and said one or more message sheets, after release, said second accumulating plane (17, 28, 28) comprising a second tray (29) apt to be in contact with said first tray (9);

c) simultaneously feeding said envelope sheet (2) and said one or more message sheets so that the complete overlaying therebetween is obtained;

d) simultaneously folding said envelope sheet (2) and said one or more message sheets, obtaining an envelope.

2. A process for the automatic enveloping of messages with a variable number of sheets according to claim 1, further comprising, subsequent to said folding, envelope sealing.

3. A process for the automatic enveloping of messages with a variable number of sheets according to claim 2, further comprising, subsequent to said sealing, envelope sorting.

4. A process for the automatic enveloping of messages with a variable number of sheets according to claim 1, wherein the last of said message sheets has symbols for enabling the end of the supply of said message sheets.

5. A process for the automatic enveloping of messages with a variable number of sheets according to claim 1, wherein the supply of the message sheets is performed in two steps, temporally distinct one from the other.

6. A process for the automatic enveloping of messages with a variable number of sheets according to claim 5, wherein the last of the message sheets supplied in the first supply step has symbols for enabling the end of the first supply step and the start of the second supply step of the message sheets.

7. A machine for the automatic enveloping of messages with a variable number of sheets, comprising:

first means (8; 11, 12, 13, 14, 15, 16, 17, 18, 19) for supplying one or more message sheets;

a first accumulating plane (9, 48) limited to only accumulating one or more message sheets, located downstream of said first means (8; 11, 12, 13, 14, 15, 16, 17, 18, 19) for supplying said one or more message sheets and comprising a first tray (9) and a platen (48);

second means (16, 25, 26, 27) for supplying an envelope sheet;

a second accumulating plane (17, 28, 29) for accumulating said envelope sheet, located downstream of said second means (16, 25, 26, 27) for supplying said envelope sheet, said second accumulating plane forming an angle with the first accumulating plane (9, 48), to obtain overlaying of from ends of said envelope sheet (2) and said one or more message sheets, said second accumulating plane (17, 28, 29) comprising a second tray (29) apt to be in contact with said first tray (9);

means (20) for simultaneously feeding said one or more message sheets and said envelope sheet (2), obtaining complete overlaying thereof; and means (36; 39, 40, 41, 42, 43, 44, 45, 46, 47) for simultaneously folding said envelope sheet (20, and said one or more message sheets, obtaining an envelope.

8. A machine for the automatic enveloping of messages with a variable number of sheets according to claim 7, wherein the machine it comprises means (37) for sealing the envelope, located downstream of said means (36; 39, 40, 41, 42, 43, 44, 45, 46, 47) for simultaneously folding the envelope sheets and the message sheets.

9. A machine for the automatic enveloping of messages with a variable number of sheets according to claim 8, wherein the machine it comprises means (38) for sorting out the envelope, located downstream of said means (37) for sealing the envelope.

10. A machine for the automatic enveloping of messages with a variable number of sheets according to claim 9, wherein the means for supplying the message sheets comprise means (18, 19) for feeding and directing, capable of assuming an operating position, in which they are located in contact with the second accumulating plane and enable accumulating of the message sheets on the first accumulating plane, and a resting position, in which they are separated from the second accumulating plane and enable accumulating of the envelope sheets on the second accumulating plane.

11. A machine for the automatic enveloping of messages with a variable number of sheets according to claim 10, wherein said first supply means supply the message sheets from two different supply sources (8, 11).

12. A machine for the automatic enveloping of messages with a variable number of sheets according to claim 11, wherein the first tray (9) and the second tray (29) are simultaneously turnable in case of malfunction.

* * * * *